US006212702B1

(12) United States Patent
Sitzmann

(10) Patent No.: US 6,212,702 B1
(45) Date of Patent: Apr. 10, 2001

(54) SPA COVER KIT

(75) Inventor: Keith Sitzmann, Bellevue, WA (US)

(73) Assignees: Derek Sitzmann; Aaron Sitzmann; Beau Sitzmann, all of Redmond, WA (US)

( * ) Notice: Subject to any disclaimer, the term of this patent is extended or adjusted under 35 U.S.C. 154(b) by 0 days.

(21) Appl. No.: 09/294,777

(22) Filed: Apr. 19, 1999

(51) Int. Cl.[7] ..... E04H 4/00

(52) U.S. Cl. ..... 4/498; 4/494; 4/580; 135/96; 52/66

(58) Field of Search ..... 4/494, 496, 498, 4/500, 503, 580; 135/96; 52/66; 108/42, 125, 129, 132, 184

(56) References Cited

U.S. PATENT DOCUMENTS

| | | | | |
|---|---|---|---|---|
| D. 280,438 | | 9/1985 | Wendt | D23/71 |
| 2,912,703 | * | 11/1959 | Murphy | 4/494 |
| 3,051,964 | * | 9/1962 | Fisher et al. | 4/494 |
| 3,464,373 | * | 9/1969 | Larson | 108/125 |
| 3,807,104 | | 4/1974 | Webster | 52/70 |
| 3,854,149 | * | 12/1974 | Mischke | 4/494 |
| 4,051,638 | | 10/1977 | Heintz | 52/63 |
| 4,068,423 | | 1/1978 | Marsh | 52/86 |
| 4,136,408 | | 1/1979 | Dahlbeck et al. | 4/172.12 |
| 4,246,663 | | 1/1981 | Aragona et al. | 4/500 |
| 4,404,980 | * | 9/1983 | Wade | 135/96 |
| 5,148,646 | | 9/1992 | Lutostanski | 52/66 |
| 5,606,831 | * | 3/1997 | Tippmann et al. | 52/169.7 |
| 5,745,932 | | 5/1998 | Barovetto | 4/498 |

* cited by examiner

*Primary Examiner*—Henry J. Recla
*Assistant Examiner*—Tuan Nguyen
(74) *Attorney, Agent, or Firm*—Dean A. Craine

(57) ABSTRACT

A lightweight, easy to assemble spa cover kit is disclosed herein. The cover kit includes a square or rectangular-shaped overhead cap pivotally attached at two corners along one end to two dual hinged support posts. The cap is made of lightweight, weather-proof material, such as molded fiberglass, and may include skylights to allow natural light through during use. The lower end of each dual hinged support post is pivotally attached to the deck surface on which the spa sits. During use, the upper end of each dual hinged support post is pivotally attached to one comer of the cap. After the lower ends of the dual hinged support posts are attached to the deck and the upper ends of the support posts are attached to the corners of the cap, the dual hinged support posts are slowly lifted to a vertical position while the cap is slowly rotated so that it is aligned horizontally over the spa. The set of fixed support posts are then inserted into opposite corners of the cap to support the cap in a horizontal position directly over the spa. The ends of the fixed support posts are then attached to the deck. Optional extension covers may be attached to the cap to provide additional covered space.

3 Claims, 5 Drawing Sheets

SPA COVER KIT

BACKGROUND OF THE INVENTION

1. Field of the Invention

This invention relates to convertible enclosures, and more particularly, to such enclosures for outdoor spas.

2. Description of the Related Art

Outdoor spas have enjoyed increasing popularity in recent years. These spas are usually built outside on a patio or deck. In several parts of the country, however, inclement weather, such as rain or snow, limits their use.

The impact of weather on the usage of a spa can be curtailed by installing a raised cover over the spa. Ideally, such covers should be elevated structures so that users of the spa may stand up in a fully upright position. The cover should be a sufficient size to slightly extend over the sides of the spa to protect users sitting on the edge of the spa. Also, the cover should be made of strong, durable material capable of withstanding normal weather conditions.

Typically, these covers are relatively heavy structures made of standard-size lumber which are cut and assembled on site by three or more individuals. What is needed is a spa cover made of lightweight materials that is pre-fabricated and distributed in a kit for easy assembly by only two individuals.

SUMMARY OF THE INVENTION

It is an object of the present invention to provide a raised cover for a spa.

It is another object of the present invention to provide such a cover that uses pre-fabricated, lightweight, durable components and can be easily connected together so that the cover can be easily and quickly assembled by only two individuals.

It is a further object of the present invention to provide such a cover that can be easily modified to cover additional areas immediately adjacent to the spa.

These and other objects are met by a lightweight, easy to assemble spa cover. The cover includes a square or rectangular-shaped cap pivotally attached at two corners to two dual hinged support posts and at the opposite corners to two fixed support posts. In one embodiment, the cap is a single unit made of lightweight, weather-proof material, such as fiberglass, which fully extends across a standard size spa. The lower end of each dual hinged support post is pivotally attached to the deck adjacent to the corners on the spa. The opposite, upper end of each dual hinged support post is pivotally attached to one corner of the cap.

The upper hinge means and lower hinge means are aligned on each dual hinged support post so that the cap may simultaneously pivot on the upper and lower hinge means as the dual hinged support posts pivotally rotate from a horizontal to a vertical orientation on the deck when positioning the cap over the spa. This feature is especially useful because it allows one or two workers to easily assemble the cover over the spa.

As the two dual hinged support posts are rotated into a vertical orientation, the free, unsupported side of the cap can be comfortably supported by one worker. The two fixed support posts are then selected, vertically aligned, and securely attached to the two unsupported corners on the cap. The lower ends of the two fixed support posts are then securely attached to the deck while the upper ends of the two fixed support posts are attached to the cap. Optional, diagonally aligned cross-braces can then be attached between the cap and each support post to further stabilize the cap.

The system may also include optional cover extensions that attach directly to the sides of the cap to provide additional covered areas. Each extension cover includes a lightweight cap and a pair of legs that can be easily and quickly installed.

DESCRIPTION OF THE PREFERRED EMBODIMENT(S)

Figure 1:
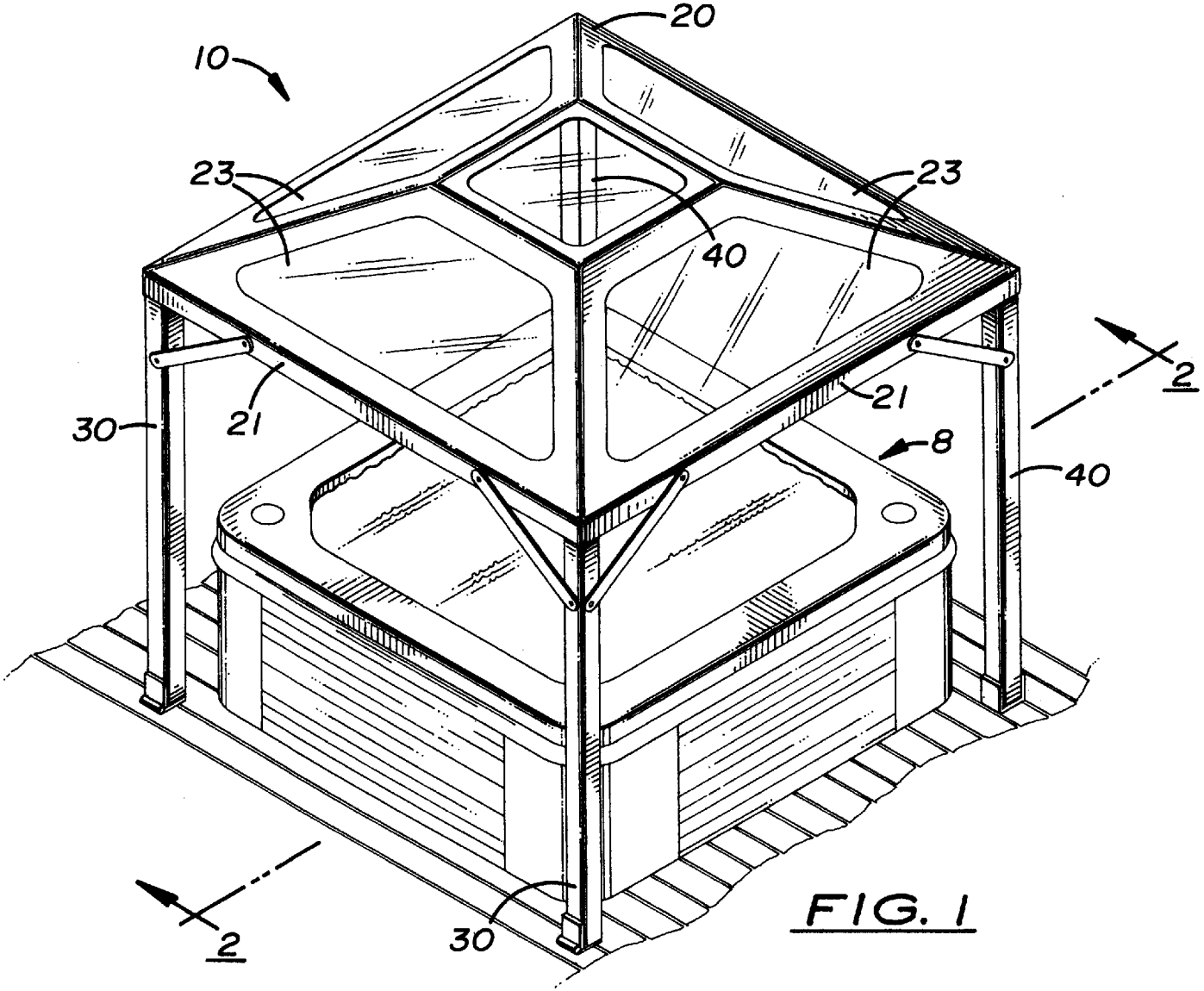
FIG. 1 is a perspective view of the spa cover system completely set up and extended over a spa.

Shown in the accompanying FIGS. 1–9 is a spa cover kit 10 designed to be installed over an existing outdoor spa 8. The kit 10 comprises a cap 20 having overall dimensions slightly larger than a standard-sized spa 8 (8'×8') capable of covering a spa 8, two dual hinged support posts 30, two fixed support posts 40 and attaching hardware further described herein.

The cap 20 is a single, prefabricated structure made of a lightweight, weather-proof material, such as molded fiberglass. In the preferred embodiment, the cap 20 is pyramidal and includes four converging support ribs with four skylight openings 23 formed between them. Skylights 23 are made of a lightweight plastic material, such as LEXAN, a polycarbonate resin sheet material made by General Electric Corporation of New York, N.Y.

Figure 2:
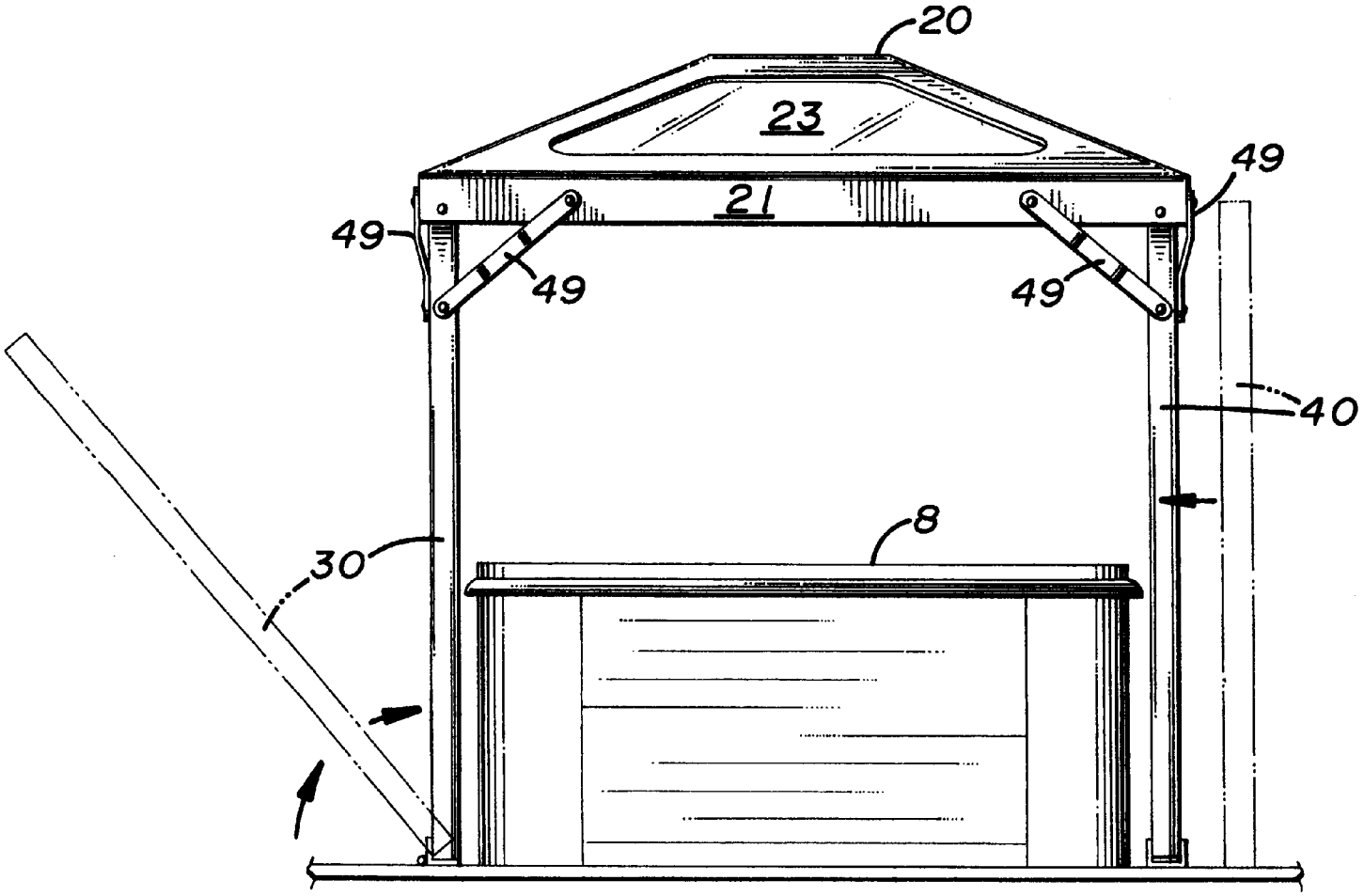
FIG. 2 is a side elevational view of the spa cover system taken along line 2—2 shown in FIG. 1.
Figure 3:
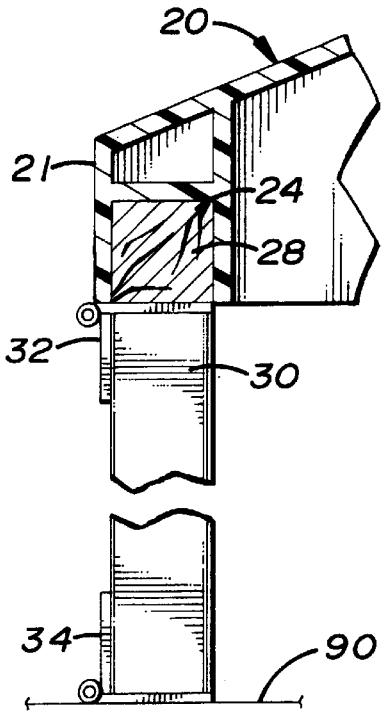
FIG. 3 is a sectional, side elevational view of a section of the cap with a block insert attached to one corner with the upper end of the dual hinged support post pivotally attached thereto and the lower end pivotally attached to the deck.
Figure 4:
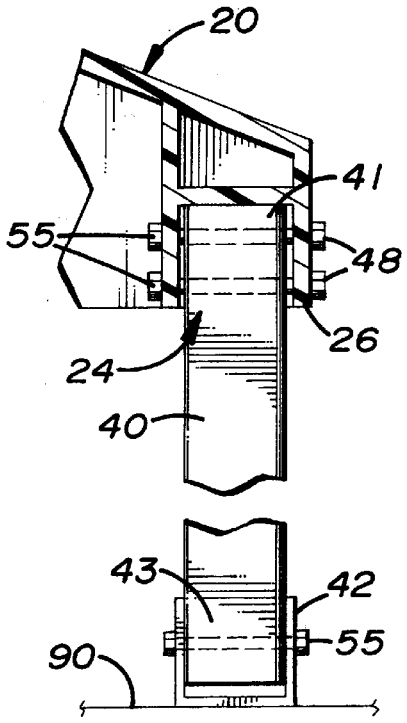
FIG. 4 is a sectional, side elevational view of a section of the cap with the upper end of the fixed support post attached thereto and the lower end fixed to the deck.

As shown in FIGS. 2 and 3, the two dual hinged support posts 30 are pivotally attached at their upper ends to the corners located on one side of the cap 8 by an upper hinge means. In the preferred embodiment, the upper hinge means comprises a leaf hinge 32 disposed between the upper end of the support post 30 and a wooden block 28 inserted into the pocket 24 formed on the corner of the cap 20. The lower ends of the dual hinged support posts 30 are attached to the deck surface 90 adjacent to the comer of the spa 8 via a lower hinge means. In the preferred embodiment, the lower hinge means is a leaf hinge 34 with one leaf attached directly to the deck adjacent to a corner on one side of the spa 8.

The two fixed support posts 40 are designed to be selectively attached to the corners opposite the dual hinged support posts 30 after the cap 20 is disposed over the spa 8. In the preferred embodiment, the upper end 41 of each fixed support post 40 is inserted into a cavity formed on the corner of the cap 20. Two perpendicularly aligned bolts 55 are then inserted through holes formed on the front and side fascia 26 of the cap 20. After being attached to the cap 20, the fixed support posts 40 are securely attached to the deck 90 using U-shaped holding brackets 42 and bolts 55. Optional stabilizing straps 49 may be attached between each support post 30 and 40 and the fascias on the cap 20.

The support posts 30, 40 are made of steel (2×2) tubing approximately 84 inches in length. The stabilizing straps 49 are approximately 1½ inches in width and 24 inches in length.

Figure 6:
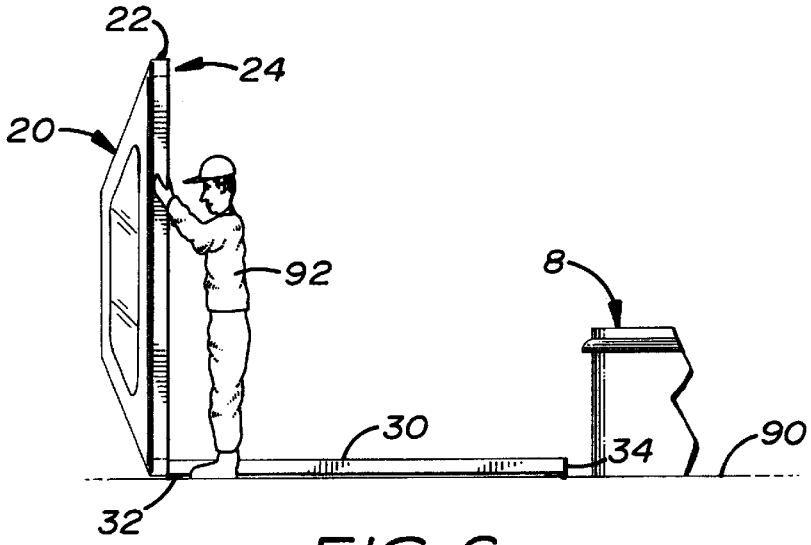
FIGS. 6–8 are illustrations showing two individuals positioning and assembling the cover over the spa.

During assembly, the two dual hinged support posts 30 are aligned in a horizontal parallel position on one side of the spa 8 as shown in FIG. 6. The lower ends of the two support posts 30 are then attached to the leaf hinges 34, which, in turn, are attached to the deck 90 adjacent to two corners on the spa 8. The cap 20 is then selected and held in a vertical position so that the wooden blocks 28 located on the two corners 22 may be connected to the upper ends of the two dual hinged support posts 30. The upper ends of the dual hinged support posts 30 and corners 22 are connected together via the leaf hinge 32.

Figure 7:
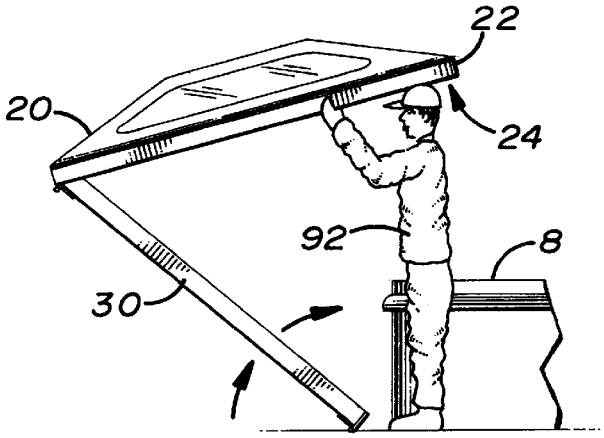
Figure 8:
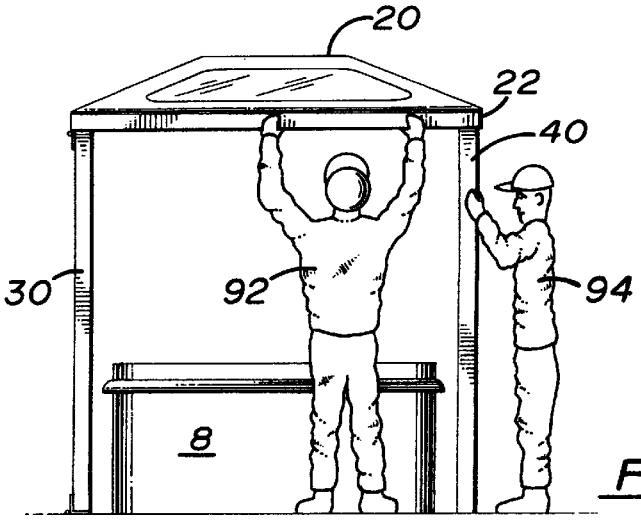

As shown in FIGS. 7 and 8, the two dual hinged support posts 30 and the cap 20 are slowly lifted so that the dual hinged support posts 30 are disposed in an upright, vertical position and the cap 20 is disposed over the spa 8. Because the cap 20 and support posts 30 are made of lightweight material, one worker 92 is usually able to properly position the cap 20 over the spa 8. Once the cap 20 is properly positioned, the worker 92 is able to hold the detached side of the cap 20 so that the fixed support posts 40 may be attached by a second worker 94. When the fixed support posts 40 are selected, the upper ends are inserted into the receiving pockets 24 located on the corners 22 of the cap 20. As shown more clearly in FIG. 4, the upper end of the fixed support posts 40 are attached to the cap 20 using bolts 48 that extend from the fascia 26, through the support post 40 and to the inside surface of the pocket 24. The lower end 43 of the fixed support posts 40 are attached to a lower bracket 44 attached to the top surface of the deck 90.

Figure 5:
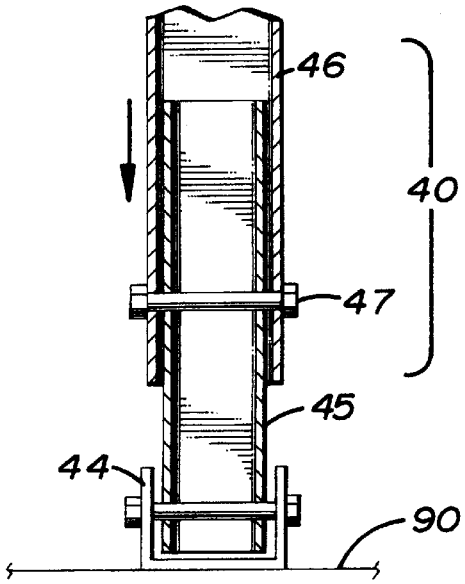
FIG. 5 is a sectional, side elevational view of the adjustable, fixed support post.

As shown in FIG. 5, the fixed support posts 40 may include a length adjustment means so that the cap 20 may be properly aligned in a horizontal orientation over the spa 8. In the preferred embodiment, the length adjustment means includes a lower telescopic leg 45 that slides longitudinally inside the lower end opening of the receiving leg 46. A bolt 47 is inserted through holes formed on the telescopic leg 45 and the receiving leg 46 to affix the legs 45, 46 in a fixed position.

Figure 9:
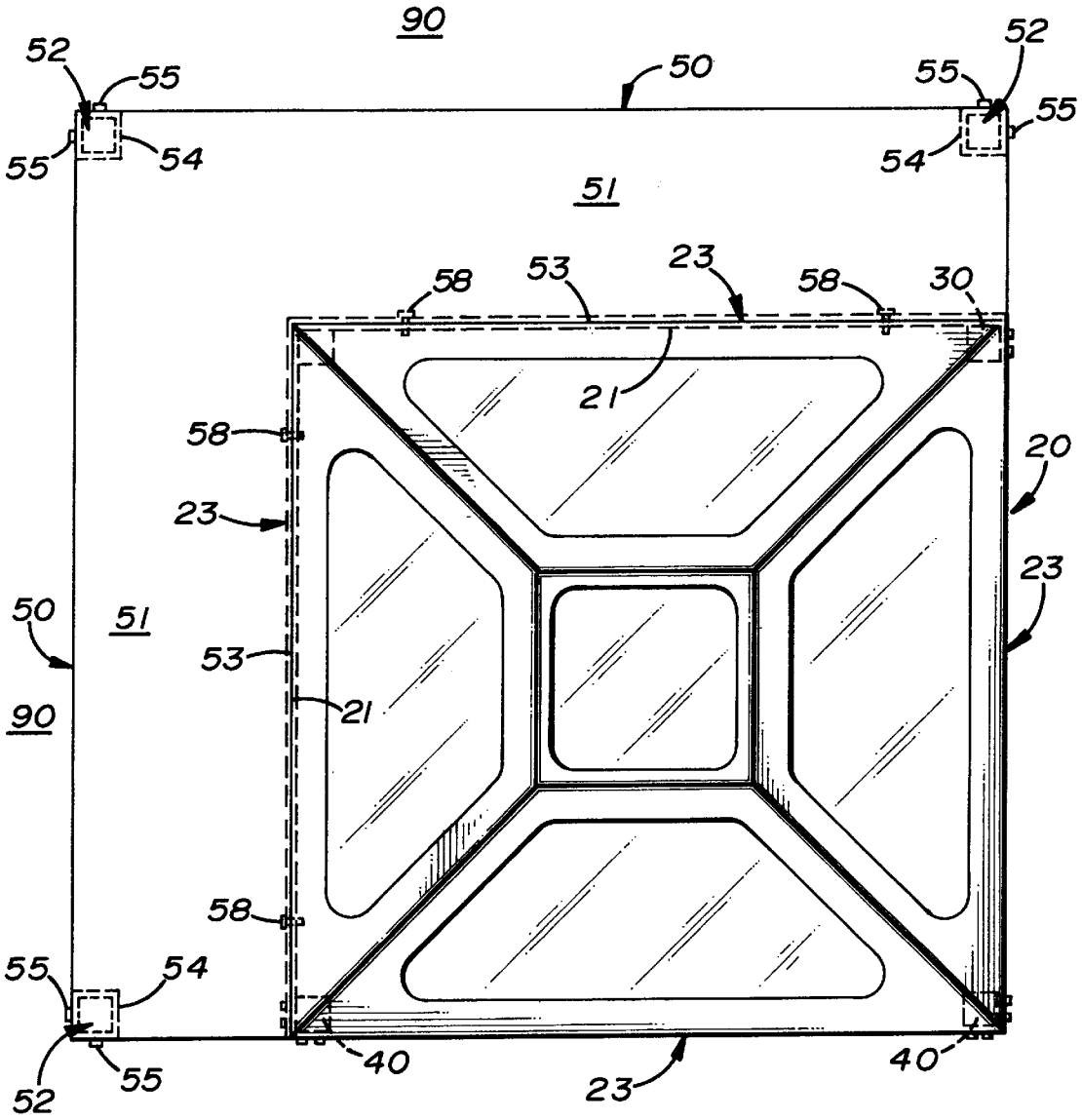
FIG. 9 is a top plan view of the spa cover with two optional extensions attached to two adjacent sides of the cap system.

The kit 10 is designed to be used with one or more optional extension covers 50 to provide additional protection over the spa. As shown in FIG. 9, an optional extension cover 50 may be attached to the front or side fascias 23 of the cap 20 to provide additional covered area around the spa 8. The extension cover 50, as shown in FIG. 9, includes an extension cap 51, a pair of fixed support posts 53, and connecting bolts 55. The extension cap 51 has a length approximately equal to the length of the cap 20. The extension cap 51 is a flat roof design made of durable, lightweight material similar to the cap 20. The support posts 52 are made of steel tubing material similar to the fixed support post 40.

During assembly of the extension cover 50, the upper ends of the fixed support posts 52 are placed into pockets 54 located in the corners of the extension cap 51. The lower ends of the fixed support posts 52 are securely attached to the deck 90 via brackets and bolts (both not shown). Bolts 58 are then used to attach the adjoining fascia surfaces 21, 53 of the cap 20 and the extension cap 51, respectively, together.

In compliance with the statute, the invention described herein has been described in language more or less specific as to structural features. It should be understood, however, that the invention is not limited to the specific features shown, since the means and construction shown comprise only the preferred embodiments for putting the invention into effect. The invention is, therefore, claimed in any of its forms or modifications within the legitimate and valid scope of the amended claims, appropriately interpreted in accordance with the doctrine of equivalents.

I claim:

1. A raised spa cover kit, comprising:

a. a rigid cap capable of extending across and covering a spa;

b. a pair of parallel aligned, dual hinged support posts, each said dual hinged support post being pivotally attached at an upper end to a corner on one side of said cap and adapted to be pivotally attached at an opposite lower end to a horizontal support surface adjacent to a spa;

c. an upper hinge means to pivotally attach said dual hinged support post to said cap;

d. a lower hinge means adapted to pivotally attach the lower end of each said dual hinged support post to a horizontal support surface each said lower hinge means adapted to be attached to a horizontal support surface on the same side of a spa and aligned on said dual hinged support post to enable said pair of dual hinged support posts to pivot in a parallel orientation between horizontal and vertical positions;

e. a pair of non-pivotal support posts securely attached in a fixed position at an upper end to the corners of said cap opposite said pair of dual hinged support posts; and f. a fixing means adapted to securely attach the lower end of each said non-pivotal support posts to a horizontal support surface on the side of a spa opposite said lower hinge means used to attached the lower ends of said dual hinged support posts to a support surface.

2. A spa cover kit, as recited in claim 1, wherein said cap is made of fiberglass.

3. A spa cover kit, as recited in claim 2, further including at least one skylight disposed on said cap.

* * * * *